US011919073B2

(12) United States Patent
Kwak et al.

(10) Patent No.: US 11,919,073 B2
(45) Date of Patent: Mar. 5, 2024

(54) APPARATUS AND METHOD FOR MANUFACTURING IRON-BASED MIXED POWDER

(71) Applicants: HYUNDAI MOTOR COMPANY, Seoul (KR); KIA CORPORATION, Seoul (KR)

(72) Inventors: Hyung Seok Kwak, Gunpo-si (KR); Jin Woo Kim, Dangjin-si (KR); Joon Chul Yun, Incheon (KR); Hyun Gon Lyu, Hwaseong-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/673,566

(22) Filed: Feb. 16, 2022

(65) Prior Publication Data

US 2022/0395902 A1 Dec. 15, 2022

(30) Foreign Application Priority Data

Jun. 15, 2021 (KR) ..... 10-2021-0077451

(51) Int. Cl.
*B22F 1/14* (2022.01)
*B22F 1/10* (2022.01)

(52) U.S. Cl.
CPC ..... *B22F 1/14* (2022.01); *B22F 1/10* (2022.01); *B22F 2202/05* (2013.01); *B22F 2301/35* (2013.01)

(58) Field of Classification Search
CPC .. B03C 1/00; B03C 1/02; B03C 1/027; B03C 1/03; B03C 1/031; B03C 1/23;
(Continued)

(56) References Cited

U.S. PATENT DOCUMENTS 2,738,234 A * 3/1956 Anderson ..... B23K 7/08 406/75
3,045,822 A * 7/1962 Cavanagh ..... B03C 1/12 209/231

(Continued)

FOREIGN PATENT DOCUMENTS

JP 2018168402 A 11/2018
JP 2019179919 A 10/2019

(Continued)

*Primary Examiner* — Ricardo D Morales
(74) *Attorney, Agent, or Firm* — LEMPIA SUMMERFIELD KATZ LLC

(57) ABSTRACT

An apparatus and method for manufacturing iron-based mixed powder with excellent flowability is provided. The apparatus includes a hopper which stores and discharges a main raw material of iron-based powder, a transport means which transports the main raw material of iron-based powder discharged from the hopper, a magnetizing means that applies magnetic force to the main raw material transported and falling from the transport means to process the main raw material of iron-based powder into a main raw material bundle in a crumbly type in which the main raw material of iron-based powder is agglomerated with each other, a first mixer in which the main raw material bundle in a magnetized state and an auxiliary raw material of iron-based powder are loaded and mixed while being rotated and transported, and a second mixer in which a first iron-based mixed powder is mixed while being rotated and transported.

6 Claims, 8 Drawing Sheets

(58) Field of Classification Search
CPC .... B03C 1/30; B03C 1/32; B03C 1/26; B03C 7/10; B03C 7/12; B22F 1/10
See application file for complete search history.

(56) References Cited

U.S. PATENT DOCUMENTS

| | | | | | |
|---|---|---|---|---|---|
| 4,786,320 | A | * | 11/1988 | Hobson | C22B 4/00 75/10.67 |
| 5,221,323 | A | | 6/1993 | Li | |
| 9,108,243 | B2 | * | 8/2015 | Stevick | C22F 1/002 |
| 2005/0217759 | A1 | | 10/2005 | Okumus et al. | |

FOREIGN PATENT DOCUMENTS

| | | | |
|---|---|---|---|
| KR | 20140069425 | A | 6/2014 |
| KR | 20160079468 | A | 7/2016 |
| KR | 20170074612 | A | 6/2017 |
| KR | 101840173 | B1 | 3/2018 |

* cited by examiner

APPARATUS AND METHOD FOR MANUFACTURING IRON-BASED MIXED POWDER

CROSS REFERENCE TO RELATED APPLICATION

The present application claims priority to Korean Patent Application No. 10-2021-0077451, filed Jun. 15, 2021, the entire contents of which is incorporated herein for all purposes by this reference.

BACKGROUND

Field

The present disclosure relates to an apparatus and method for manufacturing iron-based mixed powder, and more particularly, to an apparatus and method for manufacturing iron-based mixed powder having excellent flowability.

Description of the Related Art

Powder metallurgy materials can be used to manufacture products with complex and precise three-dimensional shapes through molding and sintering processes, and thus have the advantage of a high degree of freedom in product design. Therefore, powder metallurgy technology is widely applied to product groups with complex shapes that cannot be manufactured by casting. Among the product groups manufactured using powder metallurgy technology, automotive industry components are known as the most representative application fields.

Iron-based powder used as powder metallurgy materials is mixed powder generally obtained by mixing an iron (Fe) component such as pure iron or alloy iron, which is a main raw material, with a metal additive such as copper (Cu). The iron component and metal additive are further mixed together with lubricant and graphite as auxiliary raw materials.

There is a problem in that the flowability of such iron-based mixed powder is significantly reduced when the main raw material and the auxiliary raw material are present separately.

When the flowability of the iron-based mixed powder is reduced in this way, the speed of the molding process to process the iron-based mixed powder into a component is slowed, and characteristic deviation is caused by regions in the molded component.

In general, the iron-based mixed powder is evaluated based on the fluidity (s/50 g), which measures the time for the powder filled in a standardized volume to pass through a hole and fall by gravity (ISO 4490). However, since the iron-based mixed powder is filled in a mold having a complex cavity formed therein in the actual process of manufacturing a component using the iron-based mixed powder, it is insufficient to determine the flowability of the iron-based mixed powder only by measuring the above-described fluidity.

In particular, it is very important to uniformly fill a mold with the iron-based mixed powder without segregation in the process of manufacturing a component using the iron-based mixed powder. Therefore, research on the technology for improving the flowability of the iron-based mixed powder continues.

As a typical technology for improving the flowability of the iron-based powder mixture, there is a technology for improving the flowability by adding ultrafine additives such as metal oxides ($SiO_2$ and $TiO_2$) to the iron-based powder mixture to minimize the contact surface between the powders.

However, this technology causes a difference in local flowability due to the non-uniform distribution of the additive material, which causes a difference in the ability of the iron-based mixed powder to uniformly fill a mold depending on the location in a component (e.g., in a mold) when manufacturing the component. In particular, the difference in the ability of the iron-based mixed powder to uniformly fill a mold becomes larger as the component becomes larger.

In addition, due to the addition of a separate additive, there is a difference in the dimensional change rate during sintering. It is difficult to apply (e.g., account for, adjust for) the difference in the dimensional change rate during the molding process because the mold must be designed by reflecting the dimensional change rate in manufacturing the mold.

As another technology for improving the flowability of the iron-based mixed powder, there is a binder iron-based mixed powder manufacturing technology in which the main raw material and the auxiliary raw material are adhered by further using an organic binder in addition to the main raw material and the auxiliary raw material.

This technology dramatically improves the flowability of the iron-based mixed powder, but causes unevenly adhered parts to inevitably occur. In the iron-based mixed powder with the unevenly adhered parts, the unevenly adhered parts are present as coarse agglomerated powder, which causes a problem of coarse pores of 200 μm or greater during the sintering process.

The content described as the above background art is only to enhance understanding the background of the present disclosure, and should not be taken as an acknowledgment that the content described corresponds to the prior art already known to those having ordinary skill in the art.

SUMMARY

The present disclosure provides an apparatus and method for manufacturing iron-based mixed powder that uses magnetic force to agglomerate iron-based powder, which is a main raw material, into a crumbly type, and improves an adhesion rate with an auxiliary raw material to manufacture iron-based mixed powder with excellent flowability.

An apparatus for manufacturing iron-based mixed powder according to an embodiment of the present disclosure includes: a hopper which provides a space for storing a main raw material of iron-based powder and discharges the main raw material of iron-based powder; a transport means which transports the main raw material of iron-based powder discharged from the hopper; a magnetizing means that applies magnetic force to the main raw material of iron-based powder transported and falling from the transport means to process the main raw material of iron-based powder into a main raw material bundle in a crumbly type in which the main raw material of iron-based powder is agglomerated with each other; a first mixer in which the main raw material bundle in a state of magnetization and an auxiliary raw material of iron-based powder are loaded and mixed while being rotated and transported; and a second mixer in which a first iron-based mixed powder mixed in the first mixer is loaded, the first iron-based mixed powder being mixed while being rotated and transported.

The hopper includes an inner wall, in which the main raw material of iron-based powder is stored and discharged, the inner wall being inclined at 45-65° with respect to an axis perpendicular to a ground surface. The hopper has a cross-sectional area inside the hopper that is gradually reduced as it goes downward.

The transport means may be a vibrator feeder which applies vibration to the main raw material of iron-based powder to be transported, the vibrator feeder being installed in a horizontal direction relative to a ground surface. The vibrator feeder includes a first side disposed on a lower portion of the hopper and a second side disposed on an upper portion of the magnetizing means.

The magnetizing means includes a drum feeder which is provided rotatably on a lower side of the second side of the vibrator feeder, and to which magnetic force is applied so that the main raw material of iron-based powder is brought into contact with an outer surface of the drum feeder and aggregated with each other by the magnetic force.

The magnetizing means includes a knife disposed on a lower side of the drum feeder to separate from the drum feeder the main raw material bundle attached to the outer surface of the drum feeder in an aggregated state by the magnetic force.

The knife may be formed of a ceramic material.

A rotation speed and a transport speed of the second mixer are slower than a rotation speed and a transport speed of the first mixer.

An internal capacity of the second mixer may be larger than an internal capacity of the first mixer.

An inside of the first mixer and an inside of the second mixer are configured to be heated. In one embodiment, the inside of the first mixer is heated to a higher temperature than the inside of the second mixer.

A method for manufacturing iron-based mixed powder includes: a preparation step of preparing a main raw material of iron-based powder and an auxiliary raw material of iron-based powder; a magnetizing step of applying magnetic force to the main raw material of iron-based powder and processing the main raw material of iron-based powder into a main raw material bundle in a crumbly type in which the main raw material of iron-based powder is agglomerated with each other; a first mixing step of mixing an auxiliary raw material of iron-based powder with the main raw material bundle in a state of magnetizing, and adhering the auxiliary raw material of iron-based powder to the main raw material bundle while rotating and transporting the mixed auxiliary raw material of iron-based powder and main raw material bundle; and a second mixing step of adjusting a particle size of a first iron-based mixed powder mixed and formed in the first mixing step and cooling the mixed first iron-based mixed powder while rotating and transporting the mixed first iron-based mixed powder.

In the preparation step, the main raw material of iron-based powder is pure iron powder or alloy iron powder, and the auxiliary raw material of iron-based powder is lubricant, graphite and a metal additive.

The method further includes, between the preparation step and the magnetizing step: a discharge step of loading and temporarily storing the prepared main raw material of iron-based powder in a hopper and then discharging the main raw material of iron-based powder to a lower portion of the hopper by a weight of the main raw material of iron-based powder; and a transport step of transporting the main raw material of iron-based powder discharged in the discharge step.

In the transport step, a vibration is applied while the main raw material of iron-based powder is transported to a vibrator feeder installed in a horizontal direction relative to a ground surface.

An amplitude of the vibration applied to the main raw material of iron-based powder in the transport step may be 0.02-0.08 inches.

In the magnetizing step, the main raw material of iron-based powder is brought into contact with an outer surface of a drum feeder rotatably provided and to which magnetic force is applied, and is agglomerated with each other.

In the magnetizing step, the magnetic force applied to the drum feeder may be 0.95-1.15 KGauss.

A speed of rotating and transporting the main raw material bundle and the auxiliary raw material of iron-based powder to mix the main raw material bundle and the auxiliary raw material of iron-based powder in the first mixing step may be faster than a speed of rotating and transporting the main raw material bundle and the auxiliary raw material of iron-based powder in the second mixing step.

In the first mixing step, the speed of rotating the main raw material bundle and the auxiliary raw material of iron-based powder may be 750-950 RPM, and the speed of transporting the main raw material bundle and the auxiliary raw material of iron-based powder may be 10-14 m/s. In the second mixing step, the speed of rotating the main raw material bundle and the auxiliary raw material of iron-based powder may be 80-120 RPM, and the speed of transporting the main raw material bundle and the auxiliary raw material of iron-based powder may be 2-3 m/s.

In the first mixing step and the second mixing step, the main raw material bundle and the auxiliary raw material of iron-based powder are heated and mixed. A heating temperature of the main raw material bundle and the auxiliary raw material of iron-based powder in the first mixing step may be set greater than a heating temperature of the main raw material bundle and the auxiliary raw material of iron-based powder in the second mixing step.

The heating temperature of the main raw material bundle and the auxiliary raw material of iron-based powder in the first mixing step may be 100-200° C. The heating temperature of the main raw material bundle and the auxiliary raw material of iron-based powder in the second mixing step may be 25-60° C.

DETAILED DESCRIPTION

Figure 1:
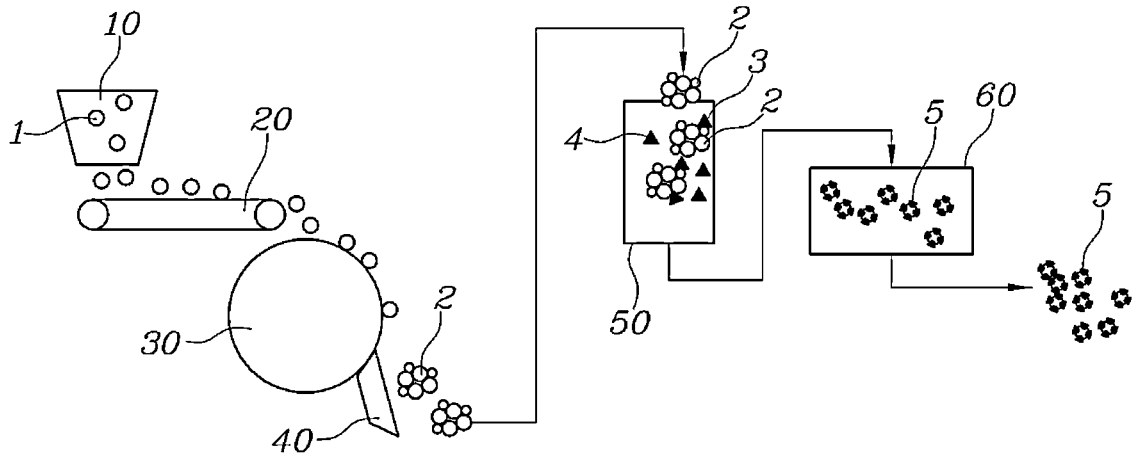
FIG. 1 is a view showing an apparatus for manufacturing iron-based mixed powder according to an embodiment of the present disclosure.

Hereinafter, embodiments of the present disclosure are described in more detail with reference to the accompanying drawings. However, the present inventive concept is not limited to the embodiments disclosed below but may be implemented in a variety of different forms. The present embodiments are provided only to complete the disclosure of the present inventive concept, and to fully inform those having ordinary skill in the art of the scope of the inventive concept. In the drawings, like reference numerals refer to like elements. When a component, device, element, or the like of the present disclosure is described as having a purpose or performing an operation, function, or the like, the component, device, or element should be considered herein as being "configured to" meet that purpose or to perform that operation or function.

FIG. 1 is a view showing an apparatus for manufacturing iron-based mixed powder according to an embodiment of the present disclosure.

As shown in FIG. 1, an apparatus for manufacturing iron-based mixed powder according to an embodiment of the present disclosure includes a hopper 10, a transport means 20, magnetizing means 30 and 40, a first mixer 50 and a second mixer 60, which are sequentially arranged.

The hopper 10 provides a space in which a main raw material of iron-based powder 1 is loaded and stored, and is a means for discharging the main raw material of iron-based powder 1 downward by its own weight.

The main raw material of iron-based powder 1 is a main component constituting iron-based mixed powder. Pure iron powder or alloy iron powder produced by water atomization may be used. As the alloy iron powder, Mo-based iron alloy, Cr-based iron alloy, and phosphorus alloy ($Fe_3P$) may be used. Hereinafter, 'main raw material of iron-based powder' is referred to as 'main raw material'.

A conventional hopper used for storage and discharge of the main raw material 1 can be used as the hopper 10. The shape and capacity of the hopper are not limited. The angle of the inner wall of the hopper 10 may be designed so that the discharge of the main raw material 1 is made smoothly.

For example, the hopper 10 may have an inner wall in which the main raw material 1 is stored and discharged, where the inner wall may be inclined at 45 to 65° with respect to an axis perpendicular to a ground surface so that the cross-sectional area of the interior of the hopper 10 is gradually reduced as it goes downward. The main raw material 1 may be manufactured by water atomization so that it is manufactured in an irregular shape.

Thus, if the angle θ of the inner wall of the hopper 10 is smaller than 45°, the speed at which the main raw material 1 moves downward by its own weight in the hopper 10 is too slow. Additionally, if the angle θ of the inner wall of the hopper 10 is smaller than 45°, the main raw material 1 from the hopper 10 may not be discharged smoothly and may not fall off the inner wall of the hopper 10. In addition, if the angle θ of the inner wall of the hopper 10 is greater than 65°, the speed at which the main raw material 1 moves downward by its own weight in the hopper 10 is too fast, and the main raw material 1 from the hopper 10 may be excessively discharged. If the amount of the main raw material 1 discharged is not adjusted to a desired level in this way, there may be a problem in that the main raw material 1 is supplied in an undesired amount to the transport means 20, which is disposed subsequently.

In particular, if the main raw material is excessively discharged from the hopper 10, excessive agglomeration of the main raw material may be caused while being excessively input to the magnetizing means 30 and 40 through the transport means 20.

The transport means 20 is a means for transporting the main raw material 1 discharged from the hopper and supplying the main raw material to the magnetizing means 30 and 40. The transport means 20 may be various types of transport means that can smoothly transport the main raw material 1 discharged from the hopper 10 to the magnetizing means 30 and 40. In one embodiment, as the transport means 20, a vibrator feeder 20 installed in a horizontal direction with respect to a ground surface is used. The vibrator feeder 20 may apply vibration to the main raw material 1 to be transported. The reason for using the vibrator feeder 20 to apply vibration as the transport means 20 is to ensure that the main raw material is evenly distributed during the transport of the main raw material 1.

Therefore, in an embodiment, one side (i.e., a first side) of the vibrator feeder 20, which is the transport means 20, is disposed on a lower portion of the hopper 10. The other side (i.e., a second side) of the vibrator feeder 20 is disposed on an upper portion of the magnetizing means 30 and 40.

The strength of vibration applied to the main raw material 1 and the transporting amount of the main raw material 1 using the vibrator feeder 20 may be variously changed according to the manufacturing amount of iron-based mixed powder. The amplitude of the vibration applied to the main raw material may be set to to 0.02 to 0.08 inches for smooth transport and uniform distribution of the main raw material 1. Further, the amplitude of vibration may be set to 0.045 inches.

The magnetizing means 30 and 40 apply magnetic force to the main raw material 1 that is transported and fallen from the transport means 20. The magnetizing means 30 and 40 thereby weakly magnetize the main raw material 1 so that the main raw materials 1 are agglomerated with each other. Therefore, the main raw materials 1 passing through the magnetizing means 30 and 40 are appropriately agglomerated with each other and become a crumbly type. Hereinafter, the main raw materials 1 that are agglomerated with each other to become a crumbly type is referred to as a main raw material bundle 2.

The 'crumbly type' refers to a state in which the main raw materials 1 are adhered to each other with an appropriate adhesive force. In addition, 'appropriate adhesive force' means that the main raw materials 1 maintain an agglomerated state until an initial process in which an auxiliary raw material of iron-based powder 3 is adhered to the main raw material bundle 2 and iron-based mixed powder 5 is formed, which occurs later. Thereafter, the iron-based mixed powder 5 is divided to have an appropriate particle size, in the process in which the iron-based mixed powders 5 are in contact with each other or are transported.

As the magnetizing means 30 and 40, various types of magnetizing means that apply magnetic force to the main raw materials 1 falling from the transport means 20 so that they agglomerate with each other may be used. One embodiment may include a drum feeder 30 that is rotatably provided in the lower portion of the other side (i.e., second side) of the vibrator feeder 20, i.e., the transport means 20, and is provided with magnetic force. The reason why the drum-type feeder is applied as the magnetizing means 30 and 40 is to provide magnetic force while appropriately controlling the time the drum-type feeder is in contact with the surface of the main raw material while the main raw material 1 is falling by its own weight.

Therefore, the drum feeder 30 is disposed on the lower portion of the vibrator feeder 20. The rotational direction of the drum feeder 30 is set so that the outer surface of the drum feeder 30 to which the falling main raw material 1 is in contact faces downward.

The strength of the magnetic force applied to the main raw material 1 using the drum feeder 30 and the contact time between the drum feeder 30 and the main raw material 1 may be changed in various ways depending on the production of the iron-based mixed powder 5 and the amount of the main raw material 1. The rotation speed of the drum feeder 30 may be maintained at 70 to 90 RPM so that the main raw material 1 is agglomerated in a crumbly type. Further, the rotation speed of the drum feeder 30 may be maintained at 80 RPM.

If the rotational speed of the drum feeder 30 is out of the suggested range, a magnetic force may not be applied to the main raw material 1, which results in the main raw material 1 not being properly adhered to the auxiliary raw material of iron-based powder 3. In this way, if the auxiliary raw material of iron-based powder 3 is not properly adhered to the main raw material 1, the effect of improving the flowability of the iron-based mixed powder 5 will not occur.

In addition, the strength of the magnetic force applied from the drum feeder 30 may be maintained at 0.95 to 1.15 KGauss so that the main raw material 1 is agglomerated in a crumbly type. Further, the magnetic force applied from the drum feeder 30 may be maintained at 1.05 KGauss.

If the strength of the magnetic force applied from the drum feeder 30 is smaller than the suggested range, the magnetic force applied to the main raw materials 1 may be too weak, and the main raw materials 1 may not agglomerate into a crumbly type. If the strength of the magnetic force is greater than the suggested range, the magnetic force applied to the main raw materials 1 may be too strong, and the main raw materials 1 may be excessively agglomerated. If the main raw materials 1 are excessively agglomerated, it may cause a problem of forming coarse aggregates.

The magnetizing means 30, 40 may further include a knife 40 that is disposed on the lower side of the drum feeder 30 and that separates the main raw material bundle 2 attached to the outer surface of the drum feeder 30, and in an aggregated state by the magnetic force, from the drum feeder 30.

In this case, the knife 40 may be manufactured using a non-magnetic material that is not magnetized. In one embodiment, the knife 40 is formed using a ceramic material. If the knife 40 is manufactured and used with a material having a magnetization property, the knife 40 may be magnetized by the magnetic force applied to the drum feeder. This may create a problem in that the main raw material bundle 2 may not be smoothly separated from the drum feeder 30 due to the interference of the magnetic force applied to the drum feeder 30 and the generation of static electricity.

The first mixer 50 is a means in which the main raw material bundle 2 in a magnetized state and the auxiliary raw material of iron-based powder 3 are loaded (i.e., filled, added, charged, supplied, packed, and the like) and mixed while being rotated and transported. The first mixer 50 is formed in a cylindrical shape to be rotatable at approximately a high speed. Therefore, while the main raw material bundle 2 and the auxiliary raw material of iron-based powder 3 are loaded into one side of the first mixer 50 and rotated in the inner space while being transported, the main raw material bundle 2 and the auxiliary raw material of iron-based powder 3 are adhered to each other. A first iron-based mixed powder 4, formed by the main raw material bundle 2 and the auxiliary raw material of iron-based powder 3 being adhered to one another, is discharged from the other side of the first mixer 50.

The auxiliary raw material of iron-based powder 3 is an additive that is mixed with the main raw material 1 to form the iron-based mixed powder 5. For example, a metal additive such as copper (Cu) with lubricant and graphite may be used. Hereinafter, 'auxiliary raw material of iron-based powder' is referred to as 'auxiliary raw material'.

The main raw material bundle 2 agglomerated while passing through the drum feeder 30 is loaded into the first mixer 50 in a magnetized state, and the auxiliary raw material 3 that is loaded in the first mixer 50 together with the main raw material bundle 2 is more easily adhered to the main raw material bundle 2 in a magnetized state.

The first mixer 50 allows the main raw material bundle 2 and the auxiliary raw material 3 loaded therein to be transported while being rotated. In addition, the first mixer 50 is provided to heat the main raw material bundle 2 and the auxiliary raw material 3 loaded therein.

As the first mixer 50, various types of mixers may be used depending on the heating method, but in one embodiment, oil type heating is used. This is because, in the case of non-oil heating, segregation may occur without uniformly mixing the main raw material bundle and the auxiliary raw material due to local heating.

In addition, the heating temperature of the first mixer 50 may be variously set according to the type of lubricant used as the auxiliary raw material. In one embodiment, the heating temperature of the first mixer 50 may be set to a temperature equal to or greater than the melting point of the lubricant in consideration of the melting point of the lubricant.

For example, the first mixer 50 to which the main raw material bundle 2 and the auxiliary raw material 3 are loaded may be heated to a temperature range of 100 to 200° C. Then, the first mixer 50 is set to maintain the rotation speed of 750 to 950 RPM and the transport speed of 10 to 14 m/s. In some embodiments, a rotation speed of 850 RPM and a transport speed of 12.50 m/s may be maintained. If the rotation speed and the transport speed of the first mixer 50 are lower than the suggested range, the main raw material bundles 2 maintaining magnetization are mixed with excessive agglomeration, and thus, the physical adhesion rate may be reduced by the collision of the main raw material bundle 2 and the auxiliary raw material 3. If the rotation speed and the transport speed of the first mixer 50 are greater than the suggested ranges, the shape of the main raw material bundle 2 is disformed due to excessive physical energy impact. This deformation may cause a problem in that a molding density is lowered when subsequently molding a molded article using the iron-based mixed powder 5.

The second mixer 60 is a means in which the first iron-based mixed powder 4, which is formed by the main raw material bundle 2 and the auxiliary raw material 3 being mixed and adhered in the first mixer 50, is loaded. The first iron-based mixed powder 4 is mixed while being rotated and transported. The second mixer 60 is formed in a cylindrical shape to be rotatable like the first mixer 50.

However, the internal capacity of the second mixer 60 may be greater than the internal capacity of the first mixer 50. A second mixer 60 having an internal capacity twice that of the first mixer 50 may be used.

In addition, the second mixer 60 may be set to have a rotational speed and a transport speed slower than those of the first mixer 50. For example, the second mixer 60 may be set to maintain a rotation speed of 80 to 120 RPM and a transport speed of 2 to 3 m/s. A rotation speed of 100 RPM and a transport speed of 2.45 m/s may also be used. Accordingly, the first iron-based mixed powders 4 transported while being rotated inside the second mixer 60 are prevented from colliding excessively with each other, thereby improving cooling efficiency.

If the rotation speed and the transport speed of the second mixer 60 are lower than the suggested ranges, the effect of reducing the quality deviation of the iron-based mixed powder 5 and the local agglomeration of the main raw material bundle 2 or the auxiliary raw material 3 may not occur. If the rotation speed and the transport speed of the second mixer 60 are greater than the suggested ranges, the adhered auxiliary raw material 3 in the first mixer 50 may separate from the main raw material bundle 2 and the adhesion rate may rapidly lower. This may cause a lowering of the molding density.

Therefore, while the first iron-based mixed powder 4 is loaded to one side of the second mixer 60 and transported while being rotated in the inner space, the iron-based mixed powder 5 having an appropriate level of particle size is produced by mutual physical collision. The iron-based mixed powder 5 that is cooled while the particle size is adjusted to the other side of the second mixer is discharged. Accordingly, the quality deviation of the iron-based mixed powder 5 passing through the second mixer 60 is minimized, and the agglomeration phenomenon due to excessive local adhesion of the main raw material bundle 2 or the auxiliary raw material 3 is reduced.

In addition, the second mixer 60 is also configured to heat the first iron-based mixed powder 4 loaded therein, similarly to the first mixer 50. However, in the second mixer 60, heating is performed to prevent rapid cooling of the first iron-based mixed powder 4. In the second mixer 60, the heating temperature may be lower than the heating temperature of the first mixer 50. Therefore, the first iron-based mixed powder 4 transported while being rotated inside the second mixer 60 may be uniformly and slowly cooled.

For example, in the second mixer 60, the heating temperature may be set to a temperature greater than a room temperature and lower than the heating temperature of the first mixer 50. The heating temperature may be set in the range of 25 to 60° C.

A method for manufacturing iron-based mixed powder using the apparatus for manufacturing the iron-based mixed powder according to an embodiment of the present disclosure configured as described above is described below.

Figure 2:
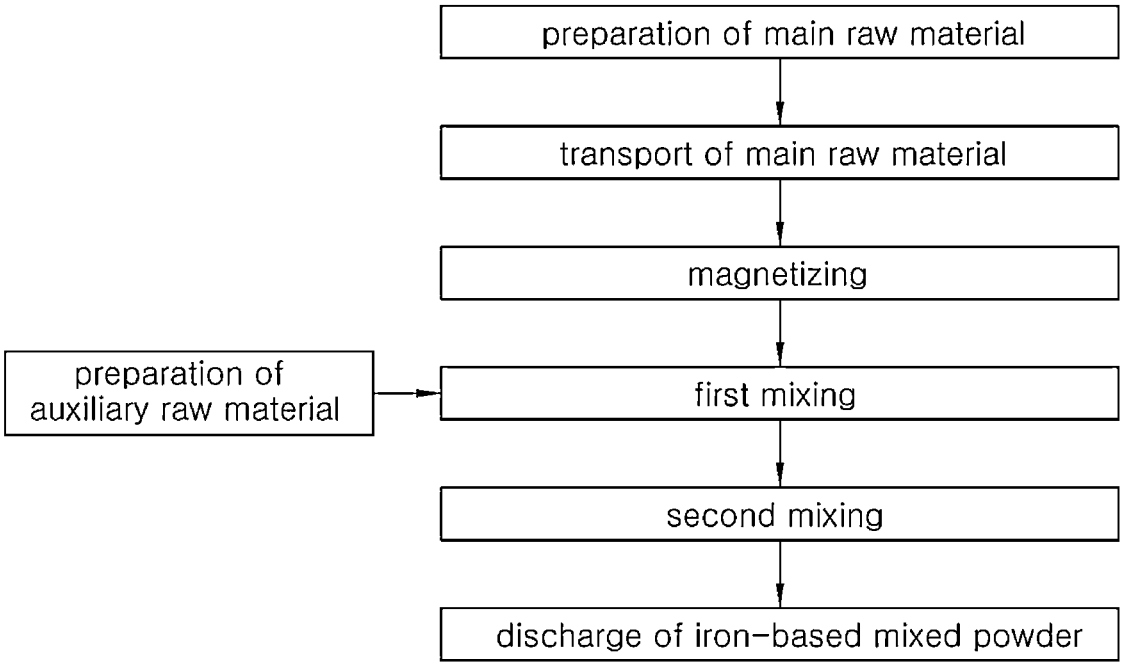
FIG. 2 is a flowchart showing a method for manufacturing iron-based mixed powder according to an embodiment of the present disclosure.

FIG. 2 is a flowchart showing a method for manufacturing iron-based mixed powder according to an embodiment of the present disclosure.

As shown in FIG. 2, the method for manufacturing iron-based mixed powder according to an embodiment of the present disclosure includes: a preparation step of preparing a main raw material of iron-based powder and an auxiliary raw material of iron-based powder; a magnetizing step of applying magnetic force to the main raw materials of iron-based powder to be agglomerated with each other and processed into a main raw material bundle in a crumbly type: a first mixing step of mixing the auxiliary raw material of iron-based powder with the main raw material bundle in a state of magnetizing, and adhering the auxiliary raw material of iron-based powder to the main raw material bundle while rotating and transporting the mixed auxiliary raw material of iron-based powder and main raw material bundle; and a second mixing step of adjusting the particle size of a first iron-based mixed powder mixed and formed in the first mixing step and cooling the mixed first iron-based mixed powder while rotating and transporting the mixed first iron-based mixed powder.

In addition, the method may further include, between the preparation step and the magnetizing step: a discharge step of loading the prepared main raw material of iron-based powder into the hopper for temporary storage, and then discharging the main raw material of iron-based powder to the lower portion of the hopper by its weight; and a transport step of transporting the main raw material of the iron-based powder discharged in the discharge step.

Hereinafter, as described above, the 'main raw material of iron-based powder' is referred to as a 'main raw material', and the 'auxiliary raw material of iron-based powder' is referred to as an 'auxiliary raw material'.

To elaborate on each step, first the main raw material and the auxiliary raw material are prepared respectively (preparation step).

In this case, pure iron powder or alloy iron powder is prepared as the main raw material, and lubricant, graphite, and a metal additive such as copper (Cu) are prepared as the auxiliary raw material.

Then, the prepared main raw material is loaded into the hopper and temporarily stored, and then discharged to the lower portion of the hopper by the weight of the main raw material (discharge step).

Then, the main raw material discharged from the hopper is transported to the drum feeder while applying vibration using the vibrator feeder installed in a horizontal direction relative to a ground surface (transport step).

In the transport step, for uniform distribution of the main raw material, the main raw material may be transported while applying vibration with an amplitude of 0.02 to 0.08 inches using the vibrator feeder.

The main raw material transported in this way falls into the drum feeder to which magnetic force is applied, and the main raw material is attached to the outer surface of the drum feeder while in contact with the rotating drum feeder. The main raw materials are weakly magnetized by the magnetic force applied by the drum feeder and agglomerated with each other (magnetizing step).

The agglomerated main raw material bundle is transported downward by the rotation of the drum feeder while attached to the drum feeder and discharged while being separated from the drum feeder by the knife disposed on the lower side of the drum feeder.

In this case, the rotation speed may be maintained from 70 to 90 RPM in the drum feeder so that the main raw material is agglomerated in a crumbly type. In addition, in order to magnetize the main raw material to an appropriate level, a magnetic force of about 0.95 to 1.15 KGauss may be applied.

Then, the main raw material bundle separated from the drum feeder is loaded into the first mixer together with the prepared auxiliary raw materials and mixed (first mixing step).

In the first mixer, the auxiliary raw material is mixed with the main raw material bundle in a state of magnetizing while being rotated and transported. Accordingly, the auxiliary raw material is adhered to the main raw material bundle. In this case, in the first mixer, the main raw material bundle and the auxiliary raw material are heated to a temperature equal to or greater than the melting point of the lubricant for effective adhesion of the auxiliary raw material.

For example, in the first mixing step, the first mixer may be set to maintain a rotation speed of 750 to 950 RPM and a transport speed of 10 to 14 m/s. In addition, in the first mixing step, the inside of the first mixer may be heated to a level of 100 to 200° C.

Thus, the main raw material bundle and the auxiliary raw material are adhered to each other while passing through the first mixer, and the first iron-based mixed powder thus adhered is discharged from the first mixer.

Then, the first iron-based mixed powder is again loaded into the second mixer. While rotating and transporting the iron-based mixed powder, the particle size of the iron-based mixed powder is adjusted and at the same time cooled slowly (second mixing step).

In the second mixer, the first iron-based mixed powder is cooled to a temperature between the temperature at the first mixing step and a room temperature. In this case, the first iron-based mixed powder is transported in a relatively wider space than that in the first mixing step at a relatively slower rotation speed and transport speed than the rotation speed and transport speed in the first mixing step.

For example, in the second mixing step, the second mixer may be set to maintain a rotation speed of 80 to 120 RPM and a transport speed of 2 to 3 m/s. Also, in the second mixing step, the inside of the second mixer may be heated and maintained at a level of 25 to 60° C.

Therefore, as the first iron-based mixed powder passes through the second mixer, the particle size is appropriately adjusted to minimize the quality deviation. In addition, the agglomeration phenomenon due to excessive local attachment of the main raw material bundle or the auxiliary raw material may be reduced.

Next, the present inventive concept is described through comparative examples and other examples.

First, the flow behavior of the iron-based mixed powder prepared according to an embodiment disclosed herein was examined.

In this case, in the comparative examples, iron-based mixed powder in which the auxiliary raw material of iron-based powder was adhered to the main raw material of iron-based powder using a separate binder material was prepared. In the other examples, the iron-based mixed powder prepared according to the method for manufacturing iron-based powder according to the present disclosure was prepared.

Figure 3A:
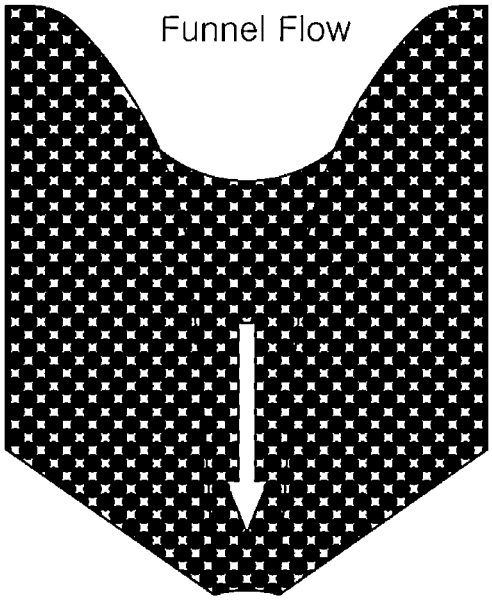
FIGS. 3*a* and 3*b* are views showing the flow behavior of iron-based mixed powder according to comparative examples and other examples.
Figure 3B:
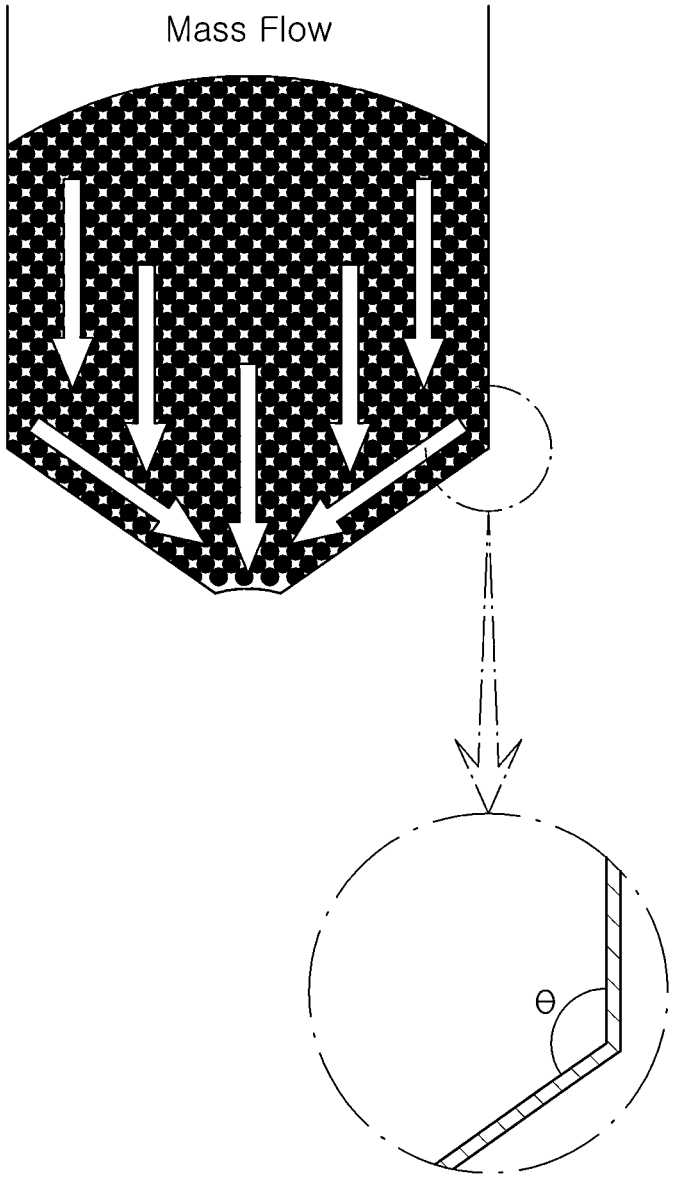

In addition, the flow behaviors of the iron-based mixed powders according to the prepared comparative examples and other examples were examined, and the results are schematically shown in FIGS. 3*a* and 3*b*. FIG. 3*a* is a view showing the flow behavior of the iron-based mixed powder according to the comparative examples, and FIG. 3*b* is a view showing the flow behavior of the iron-based mixed powder according to the other examples.

As can be seen from FIG. 3*a*, in the case of the comparative examples, the auxiliary raw material of iron-based powder was adhered to the main raw material of iron-based powder using a binder material. Thus, the degree of adhesion is non-uniform, and some iron-based mixed powders exist as coarse segregation (i.e., regions with too much coarse aggregate and not enough fine aggregate). In addition, as the comparative examples react sensitively according to an ambient temperature, it was confirmed that a funnel flow phenomenon, in which only the middle part of the powder went down first when the flowability of iron-based mixed powder was evaluated by falling within the same volume, occurred.

On the other hand, as can be seen from FIG. 3*b*, in the case of an embodiment of the present disclosure, it was confirmed that the flowability was improved and the phenomenon (mass flow) in which the entire iron-based mixed powder at a similar level fell to a discharge part occurred.

Next, an evaluation was performed to find out the particle size distribution of the iron-based mixed powder and various characteristics of the powder prepared.

The iron-based mixed powder used in the comparative examples and the other examples was Fe—Cu—C based powder, and Fe-3Cu-0.8C-0.6 L was used.

In this case, comparative examples 1 and 2 include prepared iron-based mixed powder without performing the magnetizing step, and in particular, comparative examples 1 and 2 used an amide-based binder material (melting point of 140° C.) to prepare the iron-based mixed powder in which the auxiliary material of iron-based powder is adhered to the main raw material of iron-based powder.

In other examples 1-3, the iron-based mixed powder prepared according to the method for preparing iron-based powder according to the present disclosure was prepared.

First, the change in the properties of the powder according to the presence or absence of the magnetizing step was examined, and the results are shown in Table 1 below.

TABLE 1

| | Particle distribution (%) | | | | | | Powder property | |
|---|---|---|---|---|---|---|---|---|
| Category | 180 μm or greater | 150 to 180 μm | 106 to 150 μm | 75 to 106 μm | 45 to 75 μm | 45 μm or less | Apparent density (g/cm$^3$) | Fluidity (s/sec) |
| Example 2 | 8.01 | 9.74 | 23.03 | 26.02 | 22.21 | 10.99 | 2.85 | 28.05 |
| Comparative Example 1 | 1.32 | 6.10 | 19.24 | 19.82 | 27.63 | 25.89 | 2.98 | 25.30 |

In the case of general pure iron powder, a fine fraction region (45 μm or less) has the fraction of 23 to 28% by weight, and a coarse region (150 μm or greater) has the fraction of 5 to 10% by weight.

However, as can be seen in Table 1, in the case of example 2, it was possible to confirm a sharp decrease of the fine fraction region (45 μm or less), and the fraction rate of the intermediate size region (75 to 106 μm) was significantly increased compared to comparative example 1. This result is inferred from the phenomenon that the main raw material present as fine powder is adhered to the main raw material present as coarse powder by magnetic force.

Next, the changes in the properties of the powder according to the conditions of the first mixing step and the second mixing step were examined.

In this case, the conditions in the first mixing step and the second mixing step were adjusted as described in Table 2, the evaluation results are shown in Table 3, and the resulting photos are shown in FIGS. 4*a*-6*b*.

Figure 5A:
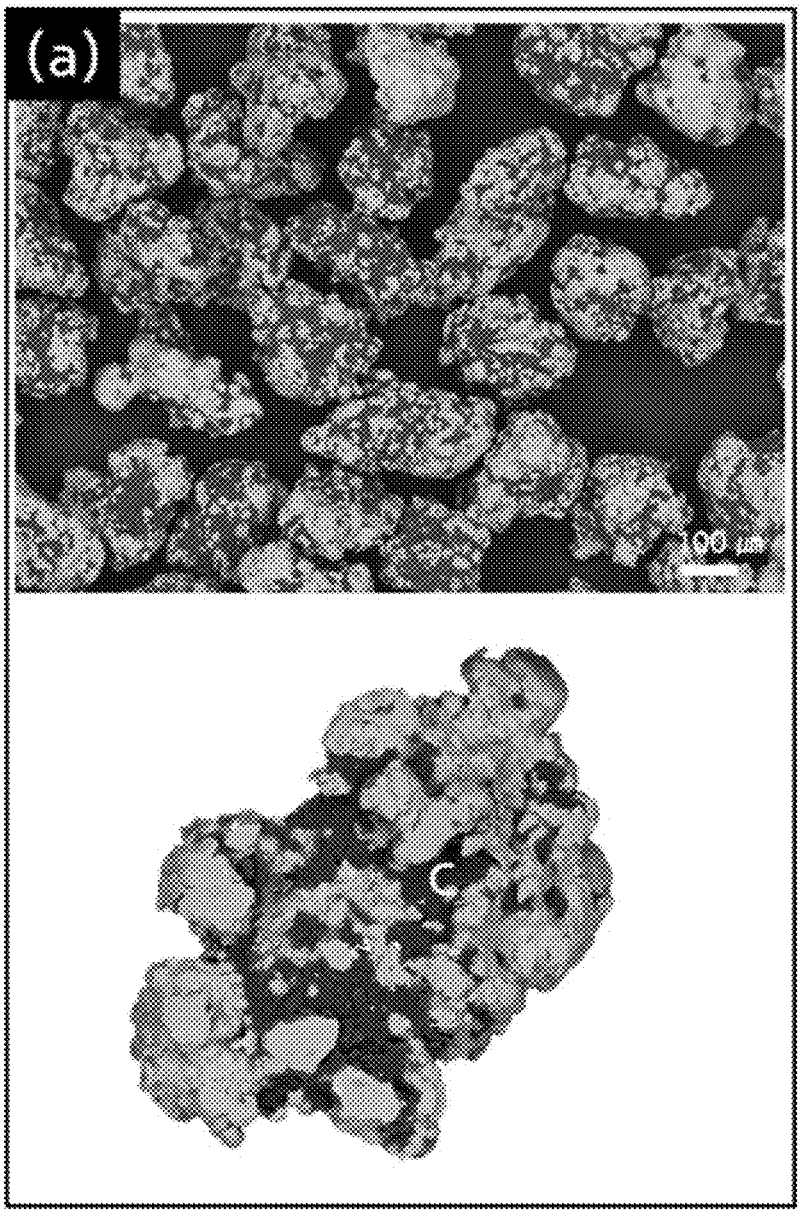
FIGS. 5*a* and 5*b* are photographs showing the microstructure of iron-based mixed powders according to comparative examples and other examples.
Figure 5B:
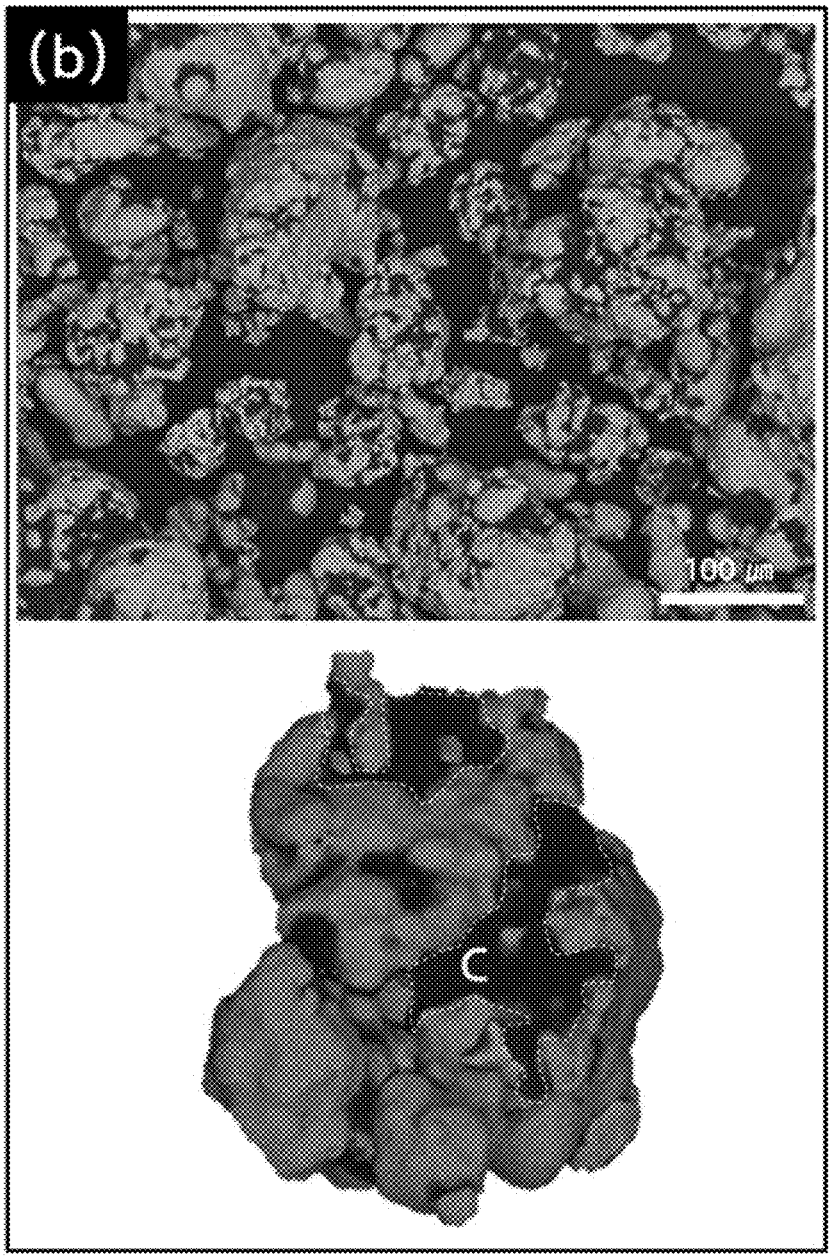
Figure 6A:
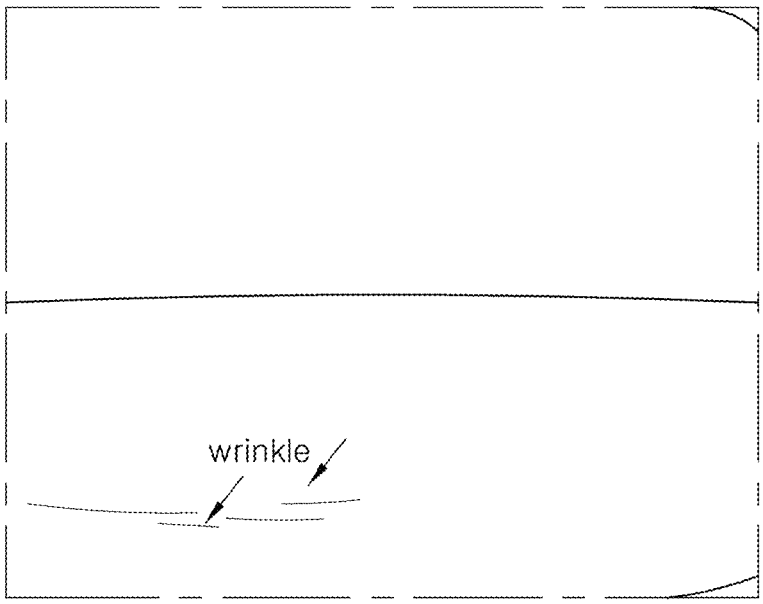
FIGS. 6*a* and 6*b* are photographs showing the surface quality of the molded body manufactured using iron-based mixed powder according to comparative examples and other examples.
Figure 6B:
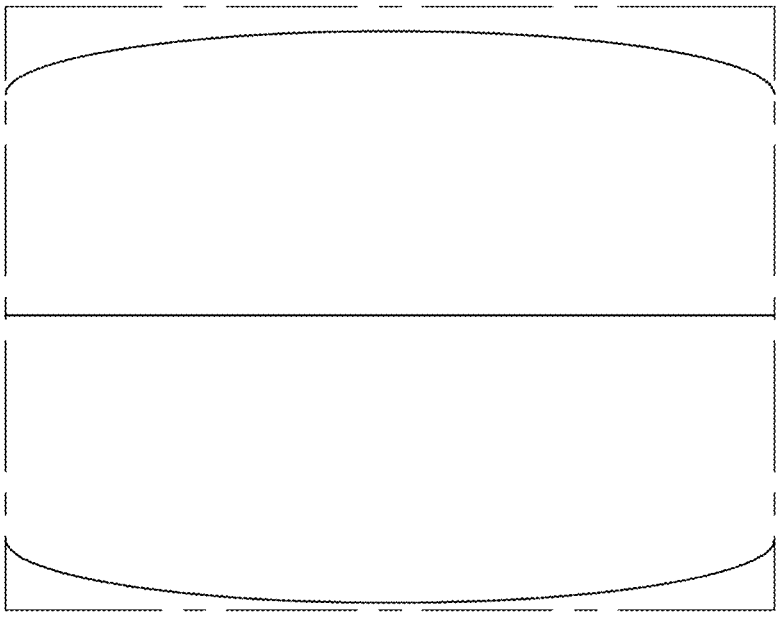

In this case, FIGS. 4*a*-4*d* are photographs showing the flowability evaluation results of iron-based mixed powders according to the comparative examples and the other examples. FIGS. 5*a* and 5*b* are photographs showing the microstructure of iron-based mixed powders according to the comparative examples and the other examples. FIGS. 6*a* and 6*b* are photographs showing the surface quality of the molded body manufactured using the iron-based mixed powder according to the comparative examples and the other examples.

TABLE 2

| Category | magnetizing step | First mixing step Speed (RPM) | Time (min) | Temperature (° C.) | Second mixing step Speed (RPM) | Time (min) | Temperature (° C.) |
|---|---|---|---|---|---|---|---|
| Example 1 | ○ | 750 (10.97 m/s) | 10 | 125 | 100 (2.45 m/s) | 7 | 25 |
| Example 2 | ○ | 850 (12.50 m/s) | 10 | 125 | 100 (2.45 m/s) | 7 | 25 |
| Example 3 | ○ | 950 (14.03 m/s) | 10 | 125 | 100 (2.45 m/s) | 7 | 25 |
| Comparative Example | x | 700 (10.20 m/s) | 30 | 150 | 50 (1.20 m/s) | 20 | 25 |
| Comparative Example 2 | x | — | — | — | — | — | — |

TABLE 3

| Category | Apparent density ($g/cm^3$) | Fluidity (s/sec) | Molding density ($g/cm^3$) @600 MPa | Flowability | Adhesion rate (%) |
|---|---|---|---|---|---|
| Example 1 | 3.25 | 29 | 7.17 | Mass Flow | 92 |
| Example 2 | 3.42 | 26 | 7.22 | Mass Flow | 97 |
| Example 3 | 3.38 | 26 | 7.19 | Mass Flow | 88 |
| Comparative Example 1 | 3.18 | 26 | 7.20 | Funnel Flow | 90 |
| Comparative Example 2 | 3.20 | 26 | 7.20 | Funnel Flow | 95 |

It should be known that the apparent density is generally greatly affected by the type of binder material.

Thus, as can be seen from Table 3, in comparative examples 1 and 2, due to the application of the amide binder material, the apparent density range of the conventional iron-based mixed powder to which the amide binder material was applied was 3.10 to 3.25 g/cm3 level.

On the other hand, the apparent densities of examples 1-3 were measured to be greater than those of comparative examples 1 and 2. The fluidity also showed the same or improved results in examples 1-3 compared to comparative examples 1 and 2.

As can be seen from the results of Table 3, in the case of examples 1-3 in which the magnetizing step was performed without separately adding a binder material, unlike in comparative examples 1 and 2 in which a binder material is separately added, it was confirmed that the apparent density and fluidity were improved by performing the magnetizing step without the addition of the binder.

In addition, the molding density was also confirmed to be similar or greater in examples 1-3 compared to comparative examples 1 and 2.

In particular, it was confirmed that examples 1-3 had the most improved characteristics compared to comparative examples 1 and 2 in the flowability pattern of the powder.

Figure 4A:
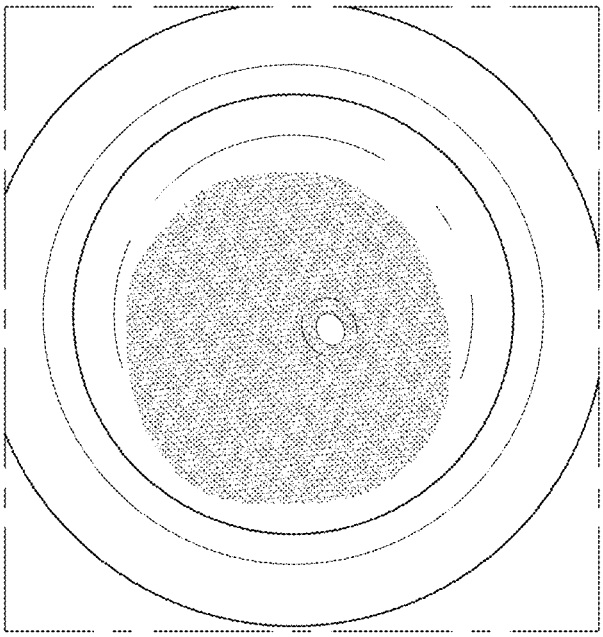
FIGS. 4*a*-4*d* are photographs showing the flowability evaluation results of iron-based mixed powders according to comparative examples and other examples.
Figure 4B:
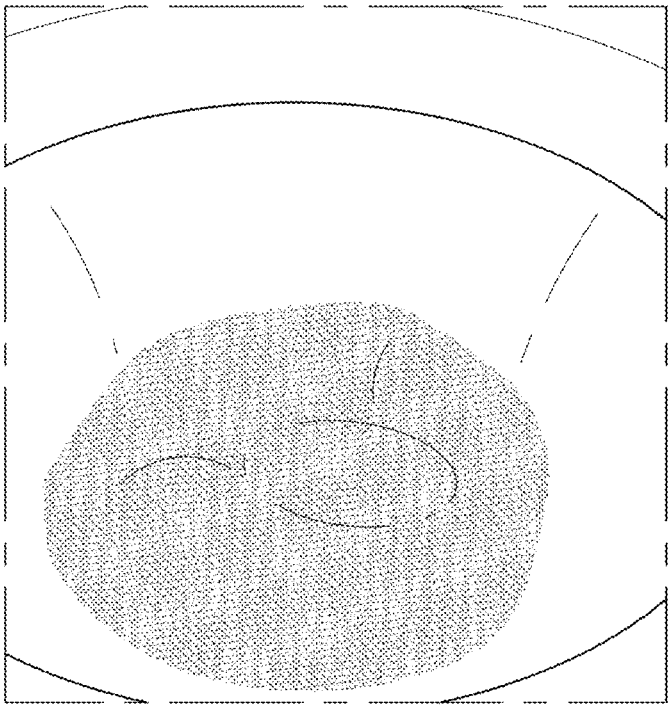
Figure 4C:
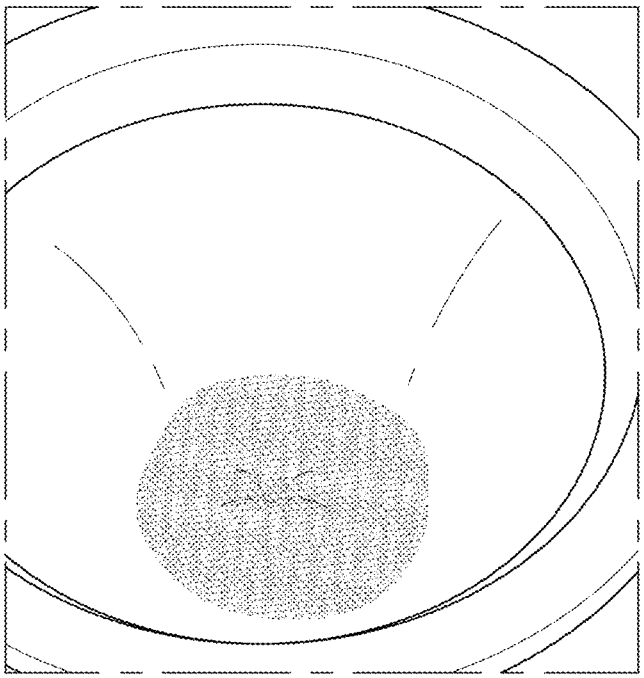
Figure 4D:
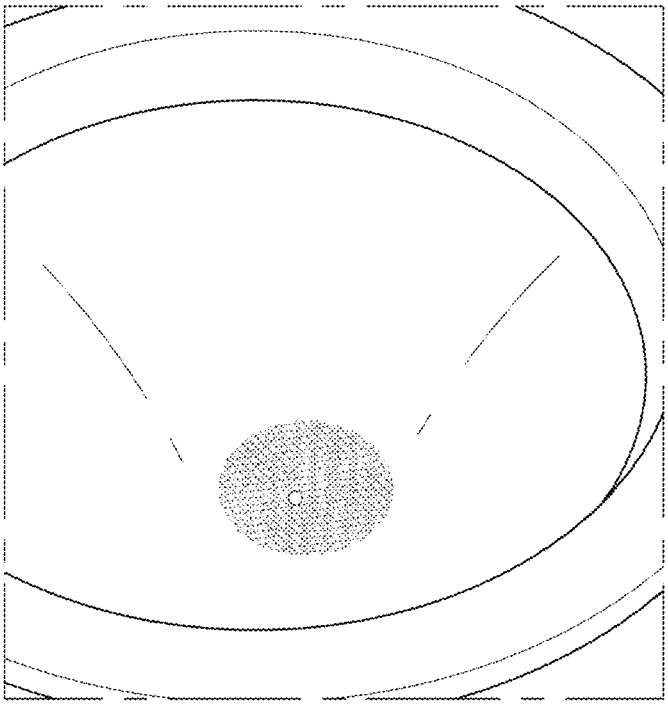

As can be seen from FIGS. 4*a*-4*d*, in FIG. 4*a* showing the case of comparative example 1, it was confirmed that only the middle portion of the powder descends first (Funnel Flow). However, in FIGS. 4*b*-4*d* showing the initial, middle and late stages of the flowability evaluation of example 2, respectively, it could be confirmed that the flowability of the powder was improved, so that the iron-based mixed powder fell at a similar level in the entire area (Mass Flow).

Therefore, although the fluidity measurement times of comparative examples 1 and 2 are similar, the difference in the powder flowability pattern greatly affects the deviation in powder filling in a complex mold when a component is manufactured. When the flowability property of the funnel flow pattern as in comparative example 1 is shown, a local weight deviation is induced due to the deviation in the filling properties of the powder in the mold, which ultimately leads to a decrease in strength and durability.

On the other hand, in the case of showing the flowability of the mass flow pattern as in example 2, it can be expected that the deviation in the ability of the iron-based mixed powder to uniformly fill a mold is stable when the powder is filled in the mold, helping improve productivity.

In addition, as can be seen in FIGS. 5*a* and 5*b*, in the case of comparative example 1, as shown in FIG. 5*a*, graphite (C) was excessively adhered between the pure iron, whereas as in FIG. 5*b* of example 2, it could be confirmed that graphite (C) was uniformly adhered between pure iron.

In particular, comparative example 1 showed a shape in which the protrusion of the pure iron powder was crushed, whereas in example 2, such a shape was not shown. The crushing of these powders and excessive adhesion of graphite are known as impeding factors of formability. For this reason, it can be inferred that the case of example 2 shows a higher molding density compared to comparative examples 1 and 2.

In addition, as can be seen in FIGS. 6*a* and 6*b*, when a molded article was molded using the iron-based mixed powder according to comparative example 1, transverse wrinkles occurred on the surface of some molded articles when the molded article was pressed as shown in FIG. 6*a*.

However, when a molded article was molded using the iron-based mixed powder according to example 2, it was confirmed that no defects were found on the surface of the molded article as shown in FIG. 6*b*.

From this result it can be concluded that as compared to comparative example 1, example 2 shows the reduction of fine powder content and uniform adhesion of graphite and auxiliary raw material by performing the magnetizing step. Thus, a binder additive, which is an agglomeration element, can be omitted.

Although the present disclosure has been described with reference to the accompanying drawings and the above-described embodiments, the present inventive concept is not limited thereto, but is defined by the following claims. Accordingly, those having ordinary skill in the art can variously change and modify the present inventive concept within the scope without departing from the spirit of the claims as described.

According to an embodiment of the present disclosure, the flowability of iron-based mixed powder can be improved by agglomerating iron-based powder into a crumbly type using magnetic force before adhering a main raw material of iron-based powder with an auxiliary raw material of lubricant, graphite and metal additive.

Accordingly, it is possible to manufacture automotive components with complex shapes without deviation in physical properties for each region by using iron-based mixed powder with improved flowability, and to manufacture soft magnetic components that have high density and minimize magnetic loss.

What is claimed is:

1. An apparatus for manufacturing iron-based mixed powder, the apparatus comprising:

a hopper which provides a space for storing a main raw material of iron-based powder and discharges the main raw material of iron-based powder;

a transport means which transports the main raw material of iron-based powder discharged from the hopper;

a magnetizing means that applies magnetic force to the main raw material of iron-based powder transported and falling from the transport means to process the main raw material of iron-based powder into a main raw material bundle in a crumbly type in which the main raw material of iron-based powder is agglomerated with each other;

a first mixer in which the main raw material bundle in a state of magnetization and an auxiliary raw material of iron-based powder are loaded and mixed while being rotated and transported; and a second mixer in which a first iron-based mixed powder mixed in the first mixer is loaded, the first iron-based mixed powder being mixed while being rotated and transported, wherein the magnetizing means includes a drum feeder which is provided rotatably on a lower side of the second side of the transport means, and to which magnetic force is applied so that the main raw material of iron-based powder is brought into contact with an outer surface of the drum feeder and aggregated with each other by magnetic force, wherein the magnetic force applied to the drum feeder is 0.95-1.15 Kgauss, wherein a rotation speed of the drum feeder is maintained at 70-90 RPM, wherein the magnetizing means includes a knife disposed on a lower side of the drum feeder to separate from the drum feeder the main raw material bundle attached to the outer surface of the drum feeder in an aggregated state by the magnetic force, and wherein the knife is formed of a ceramic material.

2. The apparatus of claim 1, wherein the hopper includes an inner wall in which the main raw material of iron-based powder is stored and discharged, the inner wall being inclined at 45-65° with respect to an axis perpendicular to a ground surface, such that a cross-sectional area inside the hopper is gradually reduced as it goes downward.

3. The apparatus of claim 1, wherein the transport means is a vibrator feeder which applies vibration to the main raw material of iron-based powder to be transported, the vibrator feeder being installed in a horizontal direction relative to a ground surface and including a first side disposed on a lower portion of the hopper and a second side disposed on an upper portion of the magnetizing means.

4. The apparatus of claim 1, wherein a rotation speed and a transport speed of the second mixer are slower than a rotation speed and a transport speed of the first mixer.

5. The apparatus of claim 4, wherein an internal capacity of the second mixer is larger than an internal capacity of the first mixer.

6. The apparatus of claim 1, wherein an inside of the first mixer and an inside of the second mixer are configured to be heated, wherein the inside of the first mixer is heated to a higher temperature than the inside of the second mixer.

* * * * *